US010365608B2

(12) United States Patent
Mertenat

(10) Patent No.: US 10,365,608 B2
(45) Date of Patent: Jul. 30, 2019

(54) TIMEPIECE WHEEL SET

(71) Applicant: ETA SA Manufacture Horlogere Suisse, Grenchen (CH)

(72) Inventor: Olivier Mertenat, Solothurn (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/309,452

(22) PCT Filed: Jun. 5, 2015

(86) PCT No.: PCT/EP2015/062542
§ 371 (c)(1),
(2) Date: Nov. 8, 2016

(87) PCT Pub. No.: WO2015/193123
PCT Pub. Date: Dec. 23, 2015

(65) Prior Publication Data

US 2017/0185040 A1 Jun. 29, 2017

(30) Foreign Application Priority Data

Jun. 18, 2014 (EP) ..... 14172870

(51) Int. Cl.
*G04B 13/02* (2006.01)

(52) U.S. Cl.
CPC ..... *G04B 13/023* (2013.01)

(58) Field of Classification Search
CPC .... G04B 17/066; G04B 17/34; G04B 13/023; G04B 13/21; G04B 13/02; G04B 13/021; G04B 13/026
See application file for complete search history.

(56) References Cited

U.S. PATENT DOCUMENTS 3,789,691 A * 2/1974 Zaugg ..... G04B 11/003 464/30
8,882,341 B2 * 11/2014 Chu ..... G04B 17/345 368/177
9,250,610 B2 * 2/2016 Daout ..... G04B 17/345
(Continued)

FOREIGN PATENT DOCUMENTS

CH 701 075 B1 11/2010
FR 1222456 6/1960
(Continued)

OTHER PUBLICATIONS

English Transation—FR 1222456—espacenet—Sep. 27, 2017.*
International Search Report dated Oct. 23, 2015 in PCT/EP2015/062542 filed Jun. 5, 2015.

*Primary Examiner* — Sean P Kayes
(74) *Attorney, Agent, or Firm* — Oblon, McClelland, Maier & Neustadt, L.L.P.

(57) ABSTRACT

A timepiece wheel set, including an arbor including a housing for reception of a plate and including, on either side of the housing, an axial abutment surface maintained in abutment on the plate, which includes a radially resilient arm and a second arm forming together a clamp clamping a radial bearing surface of the arbor in proximity to the axial abutment surface. The arbor further includes an entry ramp arranged to push back radially the first resilient arm and the second resilient arm, to allow the plate to be placed on the arbor.

21 Claims, 5 Drawing Sheets

(56) References Cited

U.S. PATENT DOCUMENTS

| | | | | |
|---|---|---|---|---|
| 9,411,314 | B2 * | 8/2016 | Daout | G04B 17/345 |
| 9,671,758 | B2 * | 6/2017 | Wu | G04B 13/021 |
| 2006/0055097 | A1 * | 3/2006 | Conus | G04B 17/066<br>267/273 |
| 2006/0187768 | A1 | 8/2006 | Murazumi | |
| 2009/0135679 | A1 * | 5/2009 | Musy | G04B 17/345<br>368/177 |
| 2013/0047437 | A1 * | 2/2013 | Daout | G04B 17/345<br>29/896.31 |
| 2015/0023140 | A1 * | 1/2015 | Daout | G04B 17/345<br>368/177 |
| 2015/0355602 | A1 * | 12/2015 | Wu | G04B 13/021<br>368/190 |
| 2016/0026154 | A1 * | 1/2016 | Courvoisier | G04B 13/02<br>368/184 |

FOREIGN PATENT DOCUMENTS

| | | | |
|---|---|---|---|
| JP | 50-91562 | A | 8/1975 |
| JP | 59-135385 | A | 8/1984 |

* cited by examiner

TIMEPIECE WHEEL SET

CROSS-REFERENCE TO RELATED APPLICATIONS

This is a National phase application in the United States of International patent application PCT/EP2015/062542 filed Jun. 5, 2015 which claims priority on European patent application 14172870.9 filed Jun. 18, 2014. The entire disclosure of the above patent application is hereby incorporated herein by reference.

FIELD OF THE INVENTION

The invention concerns a timepiece wheel set in several parts, wherein said wheel set comprises a first component, formed by an arbor which includes, about a first pivot axis, a housing arranged for reception of a second component formed by a plate in a single axial position, said plate including a peripheral surface with respect to a second pivot axis, said arbor comprising, on either side of said at least one housing, in the direction of said first pivot axis, an axial abutment surface arranged to maintain said plate in abutment on said arbor, wherein said plate comprises at least a first arm, resilient radially with respect to said second pivot axis, and at least a second arm that is stiff or resilient radially with respect to said second pivot axis, said first resilient arm and second arm together forming a clamp arranged to clamp a radial bearing surface comprised in said arbor in proximity to said axial abutment surface, wherein said arbor comprises an entry ramp arranged to push back radially each said first resilient arm and, if comprised in said plate, each said second resilient arm, to allow said plate to be placed on said arbor.

The invention also concerns a timepiece movement including at least one wheel set of this type.

The invention concerns the field of timepiece mechanisms, and more specifically gear trains.

BACKGROUND OF THE INVENTION

Numerous mechanical timepiece movements comprise at least one element with a friction fit, particularly in order to allow adjustments during operation of the watch.

For example, a mechanical movement, equipped with a centre-wheel, generally includes a friction fit as regards the motion-work.

The friction allows the canon-pinion to rotate independently of the going train, when the hands are set. The friction also allows integral rotation of the drive wheel plate during operation of the watch.

FR Patent 1222456 in the name of EBAUCHES ETA AG discloses a wheel and pinion with a plate comprising three, substantially radial, resilient arms, arranged to clamp a smooth arbor in a friction fit. More specifically, the ends of these arms have a hollow profile matching the radius of the arbor.

US Patent 2006/187768 in the name of MARAZUMI discloses a wheel structure comprising a plate resiliently secured on an arbor.

JP Patent 559135385 in the name of SEIKO discloses a plastic wheel resiliently secured on a metal pinion.

JP Patent 55091562 in the name of SEIKO discloses a wheel with a plate with spokes resiliently secured on an arbor.

SUMMARY OF THE INVENTION

To this end, the invention concerns a timepiece wheel set in several parts according to claim 1.

The invention also concerns a timepiece movement comprising at least one such wheel set, characterized in that the composition of said wheel set is limited to said arbor and to said plate assembled one on top of the other.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
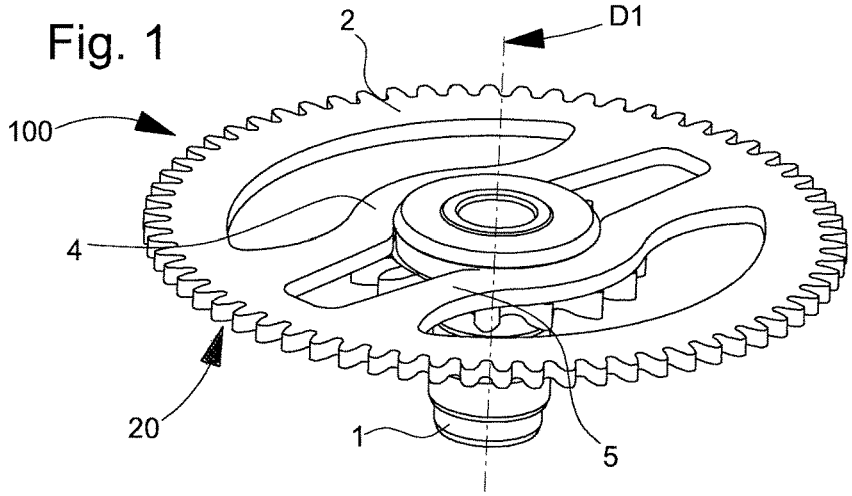
FIG. 1 shows a schematic, perspective view of a wheel set according to the invention, comprising a plate friction fitted on an arbor.
Figure 2:
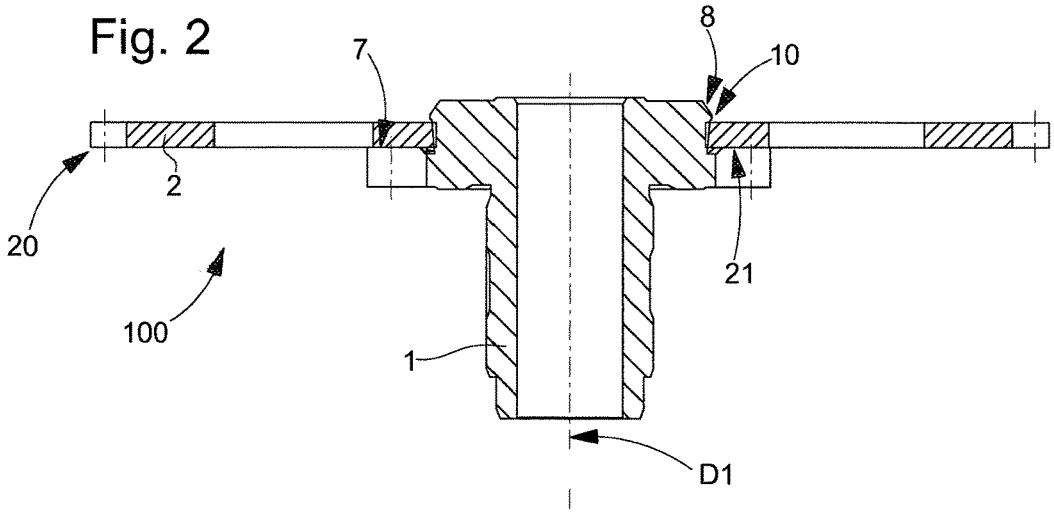
FIG. 2 shows a schematic view of the wheel set of FIG. 1, in cross-section through the pivot axis.
Figure 3:
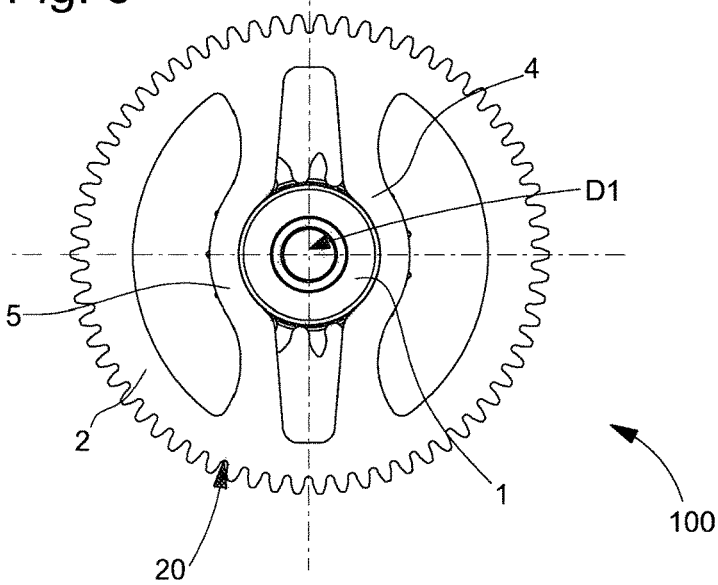
FIG. 3 shows a schematic top view of the wheel set of FIG. 1.
Figure 4:
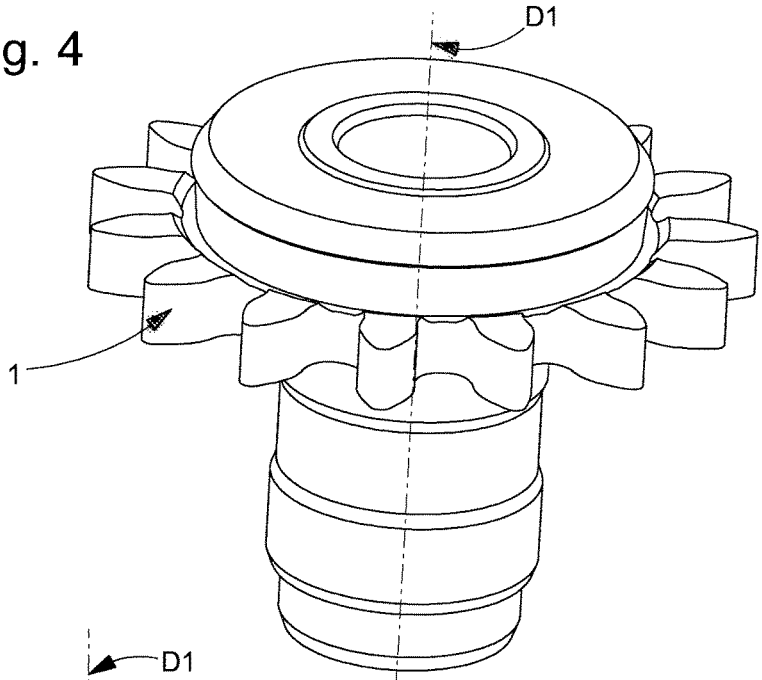
FIG. 4 shows a schematic, perspective view of the arbor comprised in the wheel set of FIG. 1.
Figure 5:
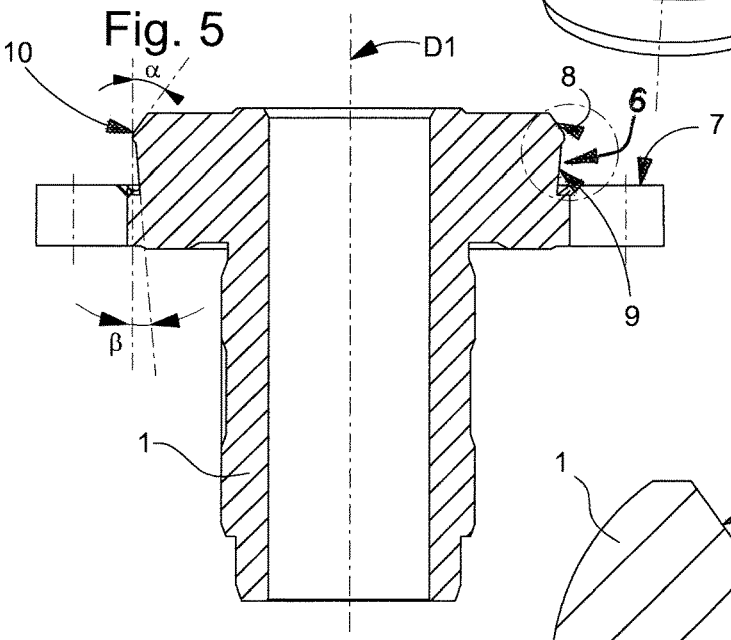
FIG. 5 shows a schematic view of the arbor of FIG. 4, in a cross-section through the pivot axis thereof.

The invention concerns a timepiece wheel set 100 in several parts.

More specifically, this wheel set comprises friction means, and is referred to as a "friction wheel set".

According to the invention, wheel set 100 comprises a first component formed by an arbor 1. This arbor 1 comprises, about a first pivot axis D1, a housing 6 arranged for reception of a second component. This second component is formed by a plate 2 in a single axial position.

Plate 2 comprises a peripheral surface 20 with respect to a second pivot axis D2.

Arbor 1 comprises, on either side of the at least one housing 6, in the direction of first pivot axis D1, an axial abutment surface 7 which is arranged to maintain plate 2 in abutment on arbor 1.

This plate 2 comprises at least a first arm 4, resilient radially with respect to second pivot axis D2, and at least a second arm 5, stiff or resilient radially with respect to second pivot axis D2.

This first resilient arm 4 and second arm 5 together form a clamp 3, which is arranged to clamp a radial bearing surface 9 comprised in arbor 1 in proximity to axial abutment surface 7. Friction is thus ensured between plate 2 and arbor 1.

In order to assemble plate 2 on arbor 1, the resilience of arms 4, 5, of plate 2 is utilised to achieve proper positioning and, preferably, a snap fit into position.

According to the invention, arbor 1 includes an entry ramp 8, which is arranged to push back radially each first resilient arm 4, and, if comprised in plate 2, each second resilient arm 5, to allow plate 2 to be placed on arbor 1.

In a specific embodiment, plate 2 comprises a first resilient arm 4, and a second resilient arm 5, which are symmetrical to each other with respect to second pivot axis D2.

Advantageously, in a free state, clamp 3 circumscribes a cylinder whose radius is smaller than that of a cylinder circumscribing radial bearing surface 9.

The central portion of plate 2 comprises as many curved surfaces, particularly substantially cylindrical surfaces, as there are arms 4, 5. In the variants illustrated by the Figures, which comprise a first resilient arm 4, and a second arm 5, the centre of the plate is defined by two curved surfaces, which clamp arbor 1.

Figure 7:
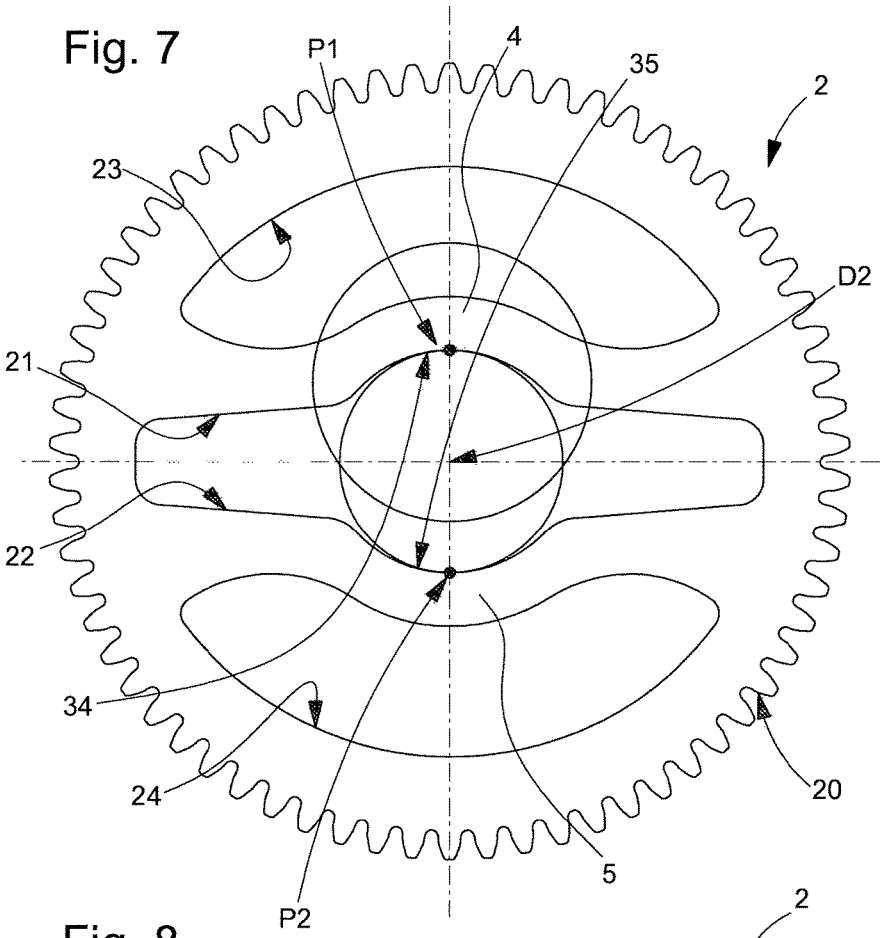
FIG. 7 shows a schematic top view of the plate comprised in the wheel set of FIG. 1, in a "two contact point" type embodiment.
Figure 8:
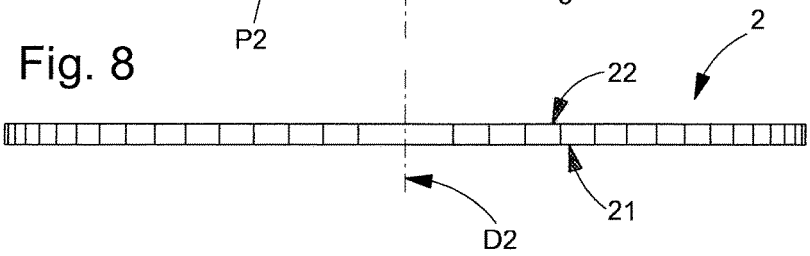
FIG. 8 is a side view of the plate of FIG. 7.

FIG. 7 illustrates a "two point" type embodiment wherein plate 2 bears on arbor 1 at two symmetrical points P1 and P2 with respect to axis D1. Each first arm 4 or second arm 5 thus comprises one such curved surface, formed by a substantially cylindrical sector, notably of hollow elliptical section 34, 35, whose axis C is off-centre with respect to second pivot axis D2.

Figure 9:
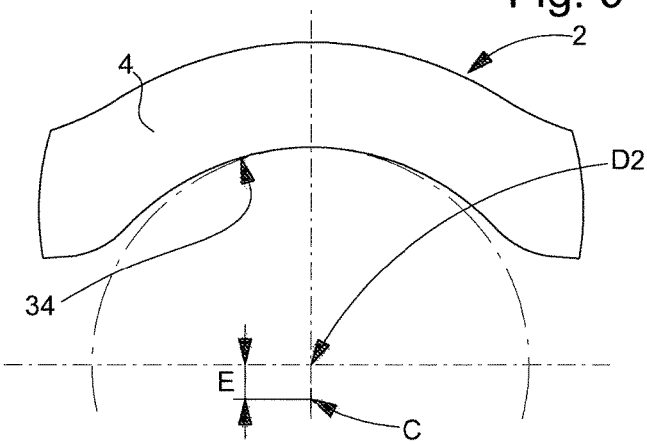
FIG. 9 is a detailed top view of a central area of the plate of FIG. 7.

Preferably, axis C is then farther from the substantially cylindrical hollow sector 34, 35 than second pivot axis D2, by an offset value E, visible in FIG. 9, which is comprised between 0.1 and 0.2 times the radius of the substantially cylindrical hollow sector 34, 35 concerned.

For motion-work friction, the friction value is advantageously defined by a precise range, from 0.060 to 0.080 N·cm, in order to satisfy quality criteria for shock behaviour and hand-setting.

It is understood that friction can be achieved, either on surfaces of a certain size, like the substantially cylindrical sectors 34, 35, or at specific points, for example in the form of a two-point or four-point friction.

Figure 10:
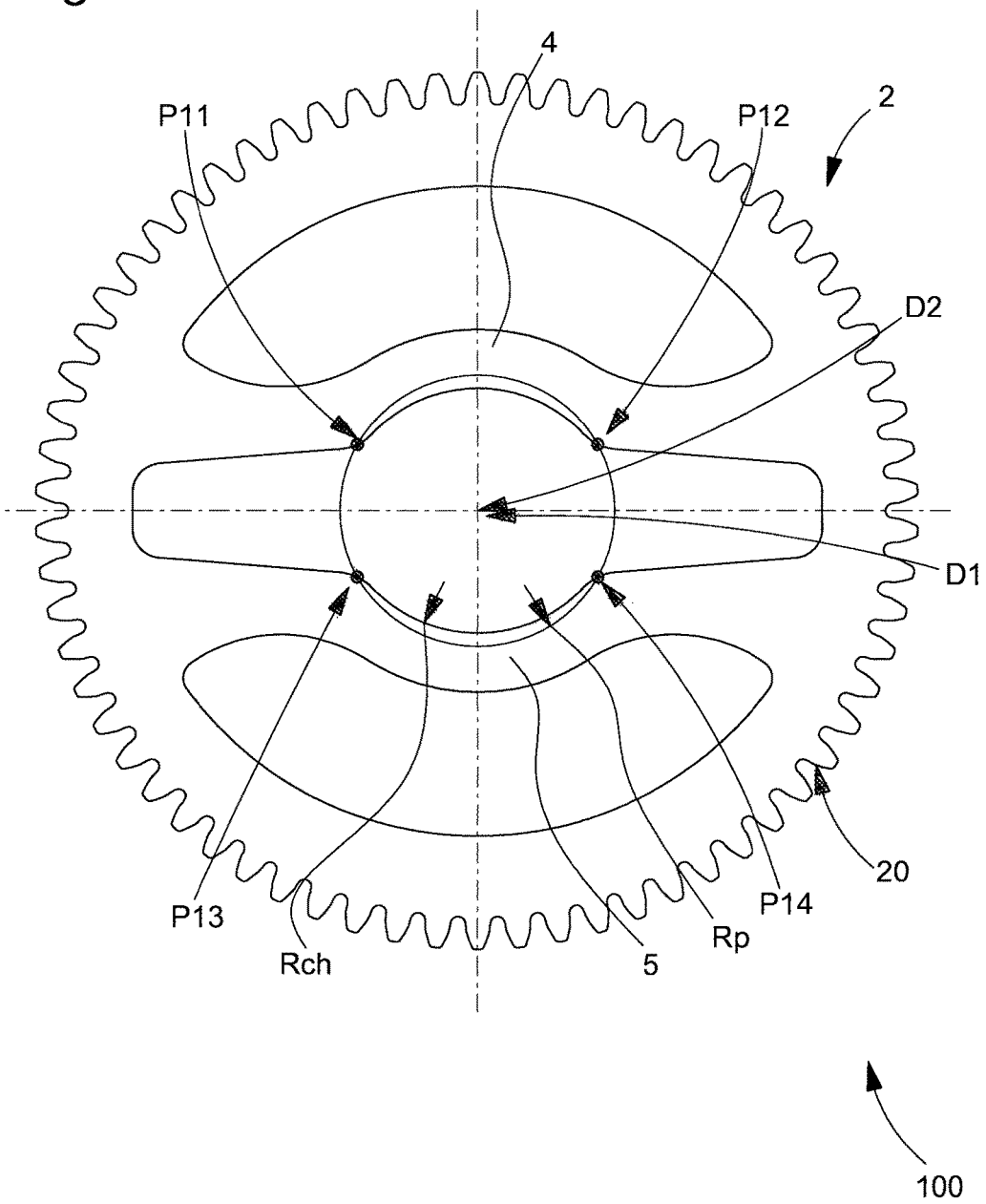
FIG. 10 shows a schematic view, similar to FIG. 7, of another embodiment with four contact points.

A "four-point" type embodiment is seen in FIG. 10: plate 2 bears on arbor 1 at four points P11, P12, P13, P14 in symmetrical pairs with respect to axis D1. The inner radius Rp of the plate is thus smaller than the cannon-pinion radius Rch on arbor 1. The four points are referenced P21, P22, P23, P24 for the variant of FIG. 11.

In a particular variant, plate 2 comprises first drive means 21 on first resilient arm 4, and second drive means 22 on each said second resilient arm 5, if plate 2 comprises such a resilient second arm. These first 21 and second 22 drive means comprise sectors with a raised or recessed relief profile, which are arranged to cooperate with a tool of complementary profile to open clamp 3 when plate 2 is placed on arbor 1.

More specifically, the first 21 and second 22 drive means are symmetrical with respect to second pivot axis D2.

In a variant, plate 2 may also comprise, in proximity to its periphery and in its inner portion, third 23 and fourth 24 drive means.

Advantageously, plate 2 comprises holding means, such as lugs or pierced holes or suchlike, in its stiffest portion, which are arranged to cooperate with a pulling tool.

In a particular variant, plate 2 comprises on its lower face 21 and/or upper face 22, a state of surface roughness greater than 6.3 micrometers Ra for frictional cooperation with a holding and/or pulling tool.

In a non-limiting variant, peripheral surface 20 is a toothing centred on second pivot axis D2.

In another variant, peripheral surface 20 is a cam with respect to second pivot axis D2 and to an angular reference formed by first arm 4 or by second arm 5.

In an advantageous embodiment, radial bearing surface 9 and entry ramp 8 of arbor 1 together define a flange 10, which is arranged to immobilise plate 2 on arbor 1 when the plate is in abutment on axial, abutment surface 7 of arbor 1.

In a particular variant, radial bearing surface 9 has a clearance angle with respect to flange 10. This angle of clearance allows plate 2 to be maintained at a constant height and at a constant friction radius.

Figure 6:
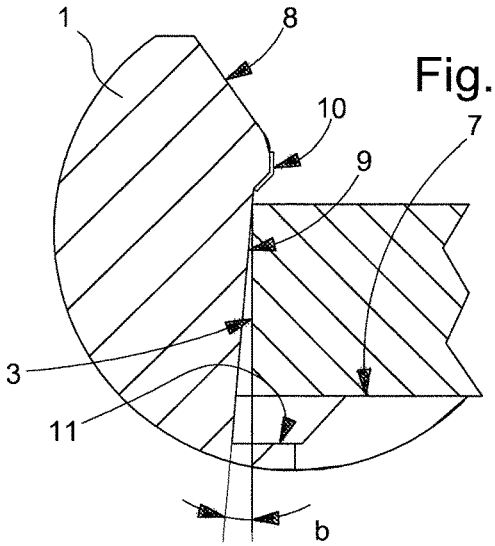
FIG. 6 is a detail of the assembly area of FIG. 2.
Figure 11:
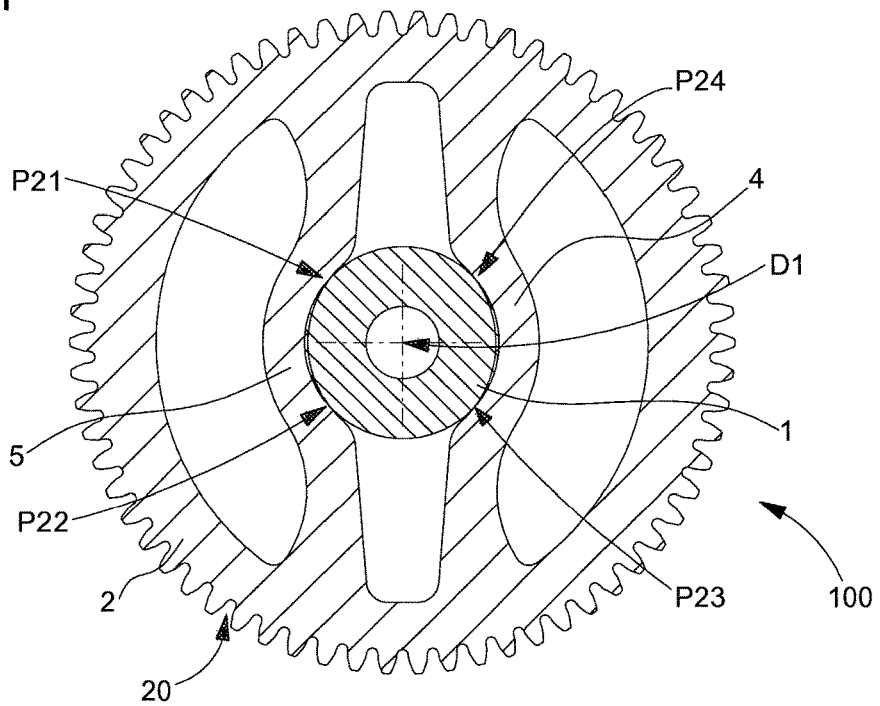
FIG. 11 shows, in a similar manner to FIG. 10, another embodiment with four contact points, which are arranged at an angle of substantially 90° from each other.
Figure 12:
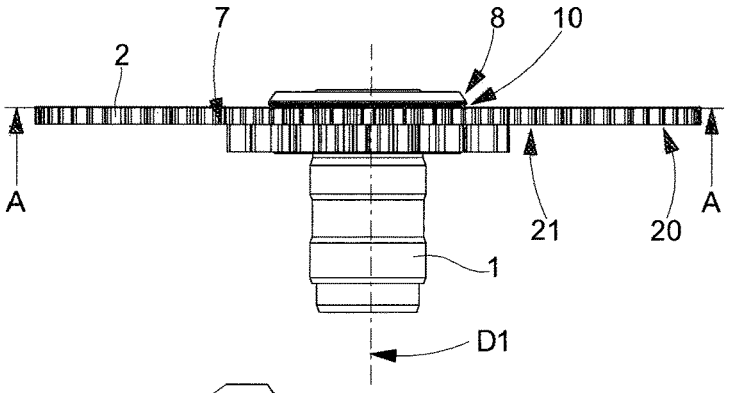
FIG. 12 is a side view of the wheel set of FIG. 11.
Figure 13:
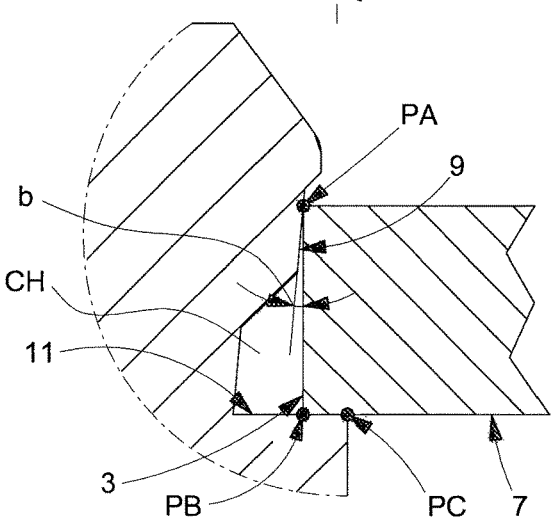
FIG. 13 is a partial sectional view of the wheel set of FIG. 11, in a plane passing through its pivot axis, with a different profile from that of FIG. 6.

The embodiment illustrated in FIGS. 11 to 13 is particularly advantageous: it is an embodiment with four points of contact P21, P22, P23, P24, which are arranged at angles of substantially 90° with respect to each other. The junction profile between the plate and the arbor, as seen in FIG. 13, is different from that of FIG. 6.

Radial bearing surface 9 of arbor 1 has a clearance angle under the flange, at a small angle "b", comprised between 2° and 8°, preferably close to 5°. The lower surface of plate 2 forms axial abutment surface 7, and is in abutment on a radial surface 11 of the arbor orthogonal to the axis D1 of the latter, on an annular surface delimited by an inner circle PB, and an outer circle PC. As a result of the resilience of the plate, and the clearance angle, the plate is securely maintained in abutment; it comes into contact on a surface substantially reduced to a circle, at PA, on the tapered cone 9 of arbor 1. The projection of circle PA, parallel to axis D1 of arbor 1, on radial abutment surface 11, is located between inner circle PB and outer circle PC, and may, as illustrated in FIG. 13, coincide with inner circle PB.

The hold thus provided is excellent, and the annular shoulder does not require a large difference in diameter, in practice, this difference between diameter PC and diameter PB may be less than 10% of the value of diameter PA. It is therefore possible, in a very advantageous manner, to greatly increase the abutment diameter PA, compared to known embodiments of wheel sets with a flange clamped on the arbor.

In this variant, a lubrication chamber CH of large volume is advantageously arranged set back from tapered cone 9, at a much more pronounced angle, for example from 30° to 45, so as to maximise the volume of chamber CH, which is delimited on the opposite side by radial surface 11; the bottom (in proximity to axis D1) of chamber CH is determined by calculating the resistance of the materials of arbor 1 as a function of the service stresses of wheel set 100.

This pitting means that chamber CH is a lubrication reservoir that remains sealed with respect to toothing 20.

In a particular embodiment, plate 2 is made of CuBe2, in a thickness close to 0.12 mm, with a toothing 20 having a pitch diameter close to 4.5 mm, for reception of an arbor 1 of a diameter close to 1.33 mm at bearing circle PA, and, in the plane of the plate, its resilient arms 4 and 5 have a section close to 0.3 mm, with a larger spacing in the free state before assembly on the arbor of approximately 1.28 mm, and thus with a clamping diameter on the arbor comprised between 0.04 and 0.05 mm. Hollow sectors 34, 35, of substantially elliptical section, comprised between P21 and P22 on the one hand, and between P23 and P24 on the other, and intended to encircle arbor 1, each have, in the free state, an eccentricity of approximately 0.2 mm.

In a more specific embodiment, toothing 20, has, in a free state, an elliptical contour to take account of the deformation of plate 2, with an eccentricity that is homothetic to that of shoulders P21-P22 and P23-P24. This toothing 20 is symmetrical with respect to a plane of symmetry passing through the axis.

This arrangement avoids allows the resilience of plate 2 to be used to a small extent when it is clamped on arbor 1, and the deformation remains confined to the elastic range, which prevents the formation of burrs. The friction value is marred only by very low dispersion.

The invention also concerns a timepiece movement 200 including at least one such wheel set 100. Preferably, the composition of this wheel set 100 is limited to arbor 1 and plate 2 assembled one on top of the other.

The invention claimed is:

1. A timepiece wheel set in plural parts, the wheel set comprising:

a first component including an arbor which includes, about a first pivot axis, a housing arranged for reception of a second component including a plate in a single axial position, the plate including a peripheral surface with respect to a second pivot axis, the arbor comprising, on either side of the at least one housing, in a direction of the first pivot axis, an axial abutment surface arranged to maintain the plate in abutment on the arbor, wherein the plate comprises at least a first arm, resilient radially with respect to the second pivot axis, and at least a second arm that is stiff or resilient radially with respect to the second pivot axis, the first resilient arm and second arm together forming a clamp arranged to clamp a radial bearing surface in the arbor in proximity to the axial abutment surface, wherein the arbor further comprises an entry ramp arranged to push back radially each first resilient arm and, when included in the plate, each second resilient arm, to allow the plate to be placed on the arbor, wherein each first arm or second arm includes one curved surface, formed by a substantially cylindrical sector, of hollow elliptical section, whose sector axis is off-center with respect to the second pivot axis, the sector axis is farther from the substantially cylindrical hollow section than the second pivot axis, by an offset value between 0.1 and 0.2 times the radius of the substantially cylindrical hollow sector, wherein the radial bearing surface and the entry ramp of the arbor define together a flange arranged to immobilize the plate on the arbor when the plate is in abutment on the axial abutment surface of the arbor, wherein the radial bearing surface having a clearance angle with respect to the flange, and wherein the plate bears on the arbor at four points, in symmetrical pairs with respect to the first pivot axis, wherein the arbor further comprises, for reception of the plate, a radial bearing surface with a clearance angle under a flange, by an angle between 2° and 8°, and wherein the plate further comprises a lower surface which forms an axial abutment surface and is in abutment on a radial surface of the arbor orthogonal to the axis of the arbor, on an annular surface delimited by an inner circle and an outer circle, the plate being, in an assembled position on the arbor, in contact with the arbor on a surface substantially reduced to a circle, on the radial bearing surface, projection of the circle, parallel to the axis of the arbor, on the radial bearing surface, being located between the inner circle and the outer circle, and coinciding with the inner circle.

2. The wheel set according to claim 1, wherein the plate includes two symmetrical surfaces with respect to the first pivot axis which include an inner plate radius that is smaller than a cannon-pinion radius included in two shoulders of the arbor that are symmetrical with respect to the first pivot axis and opposite to the two surfaces of the plate.

3. The wheel set according to claim 1, wherein, in a free state, the clamp circumscribes a cylinder of smaller radius than that of a cylinder circumscribing the radial bearing surface.

4. The wheel set according to claim 1, wherein each first arm or the second arm comprises a substantially cylindrical hollow sector whose axis is off-center with respect to the second pivot axis.

5. The wheel set according to claim 4, wherein the axis is farther from the substantially cylindrical hollow sector than the second pivot axis, by an offset value between 0.1 and 0.2 times the radius of the substantially cylindrical hollow sector.

6. The wheel set according to claim 1 wherein the plate further comprises first drive means on the first resilient arm, and second drive means on each second resilient arm, when the plate further comprises a second resilient arm, and wherein the first and second drive means comprises sectors with a raised and/or recessed relief profile arranged to cooperate with a tool of complementary profile to open the clamp when the plate is placed on the arbor.

7. The wheel set according to claim 6, wherein the first and second drive means are symmetrical with respect to the second pivot axis.

8. The wheel set according to claim 7, wherein the plate comprises holding means, in a stiffest portion thereof, to cooperate with a pulling tool.

9. The wheel set according to claim 1, wherein the plate comprises, in proximity to a periphery thereof and in the inner portion thereof, third and fourth drive means.

10. The wheel set according to claim 1, wherein the plate further comprises on a lower face and/or upper face thereof, a state of surface roughness greater than 6.3 micrometers Ra for frictional cooperation with a holding and/or pulling tool.

11. The wheel set according to claim 1, wherein the peripheral surface is a toothing centered on the second pivot axis.

12. The wheel set according to claim 1, wherein the peripheral surface is a cam with respect to the second pivot axis and to an angular reference formed by the first arm or by the second arm.

13. The wheel set according to claim 1, wherein the radial bearing surface and the entry ramp of the arbor together define a flange, arranged to immobilize the plate on the arbor when the plate is in abutment on the axial abutment surface of the arbor.

14. The wheel set according to claim 13, wherein the radial bearing surface has a clearance angle with respect to the flange.

15. The wheel set according to claim 1, wherein the four points are disposed at angles of substantially 90° with respect to each other.

16. A timepiece movement comprising:

at least one wheel set according to claim 1, wherein the arbor and the plate are assembled one on top of the other.

17. A timepiece wheel set in plural parts, the wheel set comprising:

a first component including an arbor which includes, about a first pivot axis, a housing arranged for reception of a second component including a plate in a single axial position, the plate including a peripheral surface with respect to a second pivot axis, the arbor comprising, on either side of the at least one housing, in a direction of the first pivot axis, an axial abutment surface arranged to maintain the plate in abutment on the arbor, wherein the plate further includes a first arm, resilient radially with respect to the second pivot axis, and a second arm that is stiff or resilient radially with respect to the second pivot axis, the first arm linking a first part of a periphery of the plate and a second part of the periphery, the second arm linking a third part of the periphery and a fourth part of the periphery, the first resilient arm and second arm together forming a clamp arranged to clamp a radial bearing surface included in the arbor in proximity to the axial abutment surface, wherein the arbor further comprises an entry ramp arranged to push back radially each first resilient arm and, when included in the plate, each second resilient arm, to allow the plate to be placed on the arbor, wherein the first resilient arm and the second resilient arm surround the arbor in a curved manner on either side of the second pivot axis, in proximity with a contour of the arbor, and wherein the plate bears on the arbor simultaneously at four contact points on the first arm and the second arm.

18. The wheel set according to claim 17, wherein the plate bears on the arbor at the four points, in symmetrical pairs with respect to the first pivot axis.

19. A timepiece wheel set in plural parts, the wheel set comprising:

a first component including an arbor which includes, about a first pivot axis, a housing arranged for reception of a second component including a plate in a single axial position, the plate including a peripheral surface with respect to a second pivot axis, the arbor comprising, on either side of the at least one housing, in a direction of the first pivot axis, an axial abutment surface arranged to maintain the plate in abutment on the arbor, wherein the plate further includes a first arm, resilient radially with respect to the second pivot axis, and a second arm that is stiff or resilient radially with respect to the second pivot axis, the first resilient arm and second arm together forming a clamp arranged to clamp a radial bearing surface included in the arbor in proximity to the axial abutment surface, wherein the arbor further comprises an entry ramp arranged to push back radially each first resilient arm and, when included in the plate, each second resilient arm, to allow the plate to be placed on the arbor, wherein the first resilient arm and the second resilient arm surround the arbor in a curved manner on either side of the second pivot axis, in proximity with a contour of the arbor, and wherein the plate bears on the arbor at only four contact points, wherein each first arm or second arm comprises one curved surface, formed by a substantially cylindrical sector, of hollow elliptical section, whose sector axis is off-center with respect to the second pivot axis, and wherein the sector axis is farther from the substantially cylindrical hollow section than the second pivot axis, by an offset value between 0.1 and 0.2 times the radius of the substantially cylindrical hollow sector, wherein the radial bearing surface and the entry ramp of the arbor define together a flange arranged to immobilize the plate on the arbor when the plate is in abutment on the axial abutment surface of the arbor, wherein the radial bearing surface has a clearance angle with respect to the flange, and wherein the plate bears on the arbor at four points in symmetrical pairs with respect to the first pivot axis.

20. The wheel set according to claim 17, wherein the four points are disposed at angles of substantially 90° with respect to each other.

21. A timepiece movement comprising:

at least one wheel set according to claim 17, wherein the arbor and the plate are assembled one on top of the other.

* * * * *